US005329853A

United States Patent [19]

Stegmeir et al.

[11] Patent Number: 5,329,853

[45] Date of Patent: Jul. 19, 1994

[54] BLANKET CLAMPING DEVICE

[75] Inventors: Manfred Stegmeir, Augsburg; Peer Dilling, Stätzling, both of Fed. Rep. of Germany

[73] Assignee: MAN Roland Druckmaschinen AG, Offenbach, Fed. Rep. of Germany

[21] Appl. No.: 41,712

[22] Filed: Apr. 1, 1993

[30] Foreign Application Priority Data

Apr. 1, 1992 [DE] Fed. Rep. of Germany ..... 4210778

[51] Int. Cl.[5] ..... B41F 27/12

[52] U.S. Cl. ..... 101/415.1; 101/378; 101/383

[58] Field of Search ..... 101/378, 382.1, 383, 101/415.1

[56] References Cited

U.S. PATENT DOCUMENTS 4,833,986 5/1989 Kobler ..... 101/415.1
4,848,229 7/1989 Grosshauser et al. ..... 101/382.1

FOREIGN PATENT DOCUMENTS

0060492A1 3/1982 European Pat. Off. .
0099275A1 4/1986 European Pat. Off. .
3346217A1 7/1984 Fed. Rep. of Germany .

*Primary Examiner*—Edgar S. Burr
*Assistant Examiner*—Ren Yan
*Attorney, Agent, or Firm*—Cohen, Pontani, Lieberman, Pavane

[57] ABSTRACT

A blanket clamping device for clamping a blanket mounted on a transfer cylinder of an offset rotary printing machine. The blanket is clamped by clamping rails mounted at an angle relative to each other in the clamping duct. In the middle between the clamping rails is arranged at least one screw which is screwed into the body of the transfer cylinder and has a truncated cone-shaped head. The clamping rails each have a step on a surface facing the at least one screw. Movement of the clamping rails out of the clamping duct is prevented by engagement of the steps with the truncated cone-shaped head.

2 Claims, 1 Drawing Sheet

BLANKET CLAMPING DEVICE

BACKGROUND OF THE INVENTION

1. Field of the Invention

The present invention relates to blanket clamping devices in which rubber blankets are clamped or tensioned by means of one or two clamping rails arranged in a clamping duct.

2. Description of the Related Art

In known devices for clamping the rubber blanket on the transfer cylinder of offset printing machines, the ends of the rubber blanket which are reinforced, for example, by means of strips or bars, are in engagement with clamping rails. In accordance with EP 0 060 492 A1, two clamping rails are mounted in the clamping duct of the transfer cylinder inclined at an angle relative to each other. For clamping the rubber blanket, the clamping rails are moved by means of tightening screws in direction toward the bottom of the clamping duct. The transfer cylinder may have several clamping ducts which are arranged distributed over the circumference thereof, wherein the two ends of a rubber blanket are clamped in two adjacent clamping ducts. Also known in the art are blanket clamping devices in which only one clamping rail is mounted in the clamping duct, wherein both ends of the rubber blanket are in engagement with the sides of the clamping rail (EP 0 099 275 B1).

The known blanket clamping devices have the disadvantage that the tightening screws may loosen and, consequently, the clamping rails may project out of the clamping duct and may damage the printing mechanism. This can also not be prevented by securing ledges which are screwed onto the clamping rails and cover the heads of the tightening screws.

SUMMARY OF THE INVENTION

Therefore, it is the primary object of the present invention to provide blanket clamping devices in which the clamping rails are reliably secured against loosening and projecting out of the clamping duct.

In accordance with the present invention, in a blanket clamping device having two clamping rails arranged at an angle relative to each other in the clamping duct of the transfer cylinder, wherein the ends of the blanket are fastened to the clamping rails, the above-mentioned object is met by arranging in the clamping duct in the middle between the clamping rails at least one screw which is screwed into the body of the transfer cylinder and has a truncated cone-shaped head, wherein the clamping rails have a step in each portion adjacent each of the at least one screw.

The screws with the truncated cone-shaped head press the clamping rails against the walls of the clamping duct and produce a clamping effect in this manner. When the clamping effect is absent or insufficient, the steps of the clamping rails together with the screw head prevent the clamping rails from travelling in a form-locking manner, i.e. mechanically interfitting, toward a region within the clamping duct.

In a blanket clamping device in which one clamping rail is arranged in the clamping duct of the transfer cylinder, wherein the ends of the blanket are fastened to the clamping rail, the above object is met by providing the clamping rail with at least one securing screw which cooperates with a securing element which can be moved transversely of the clamping direction out of the cross-sectional area of the clamping rail.

The various features of novelty which characterize the invention are pointed out with particularity in the claims annexed to and forming a pan of the disclosure. For a better understanding of the invention, its operating advantages, and specific objects attained by its use, reference should be had to the drawing and descriptive matter in which there are illustrated and described a preferred embodiment of the invention.

BRIEF DESCRIPTION OF THE DRAWING

The present invention is described in more detail with reference to the drawings, in which.

DESCRIPTION OF THE PREFERRED EMBODIMENTS

Figure 1:
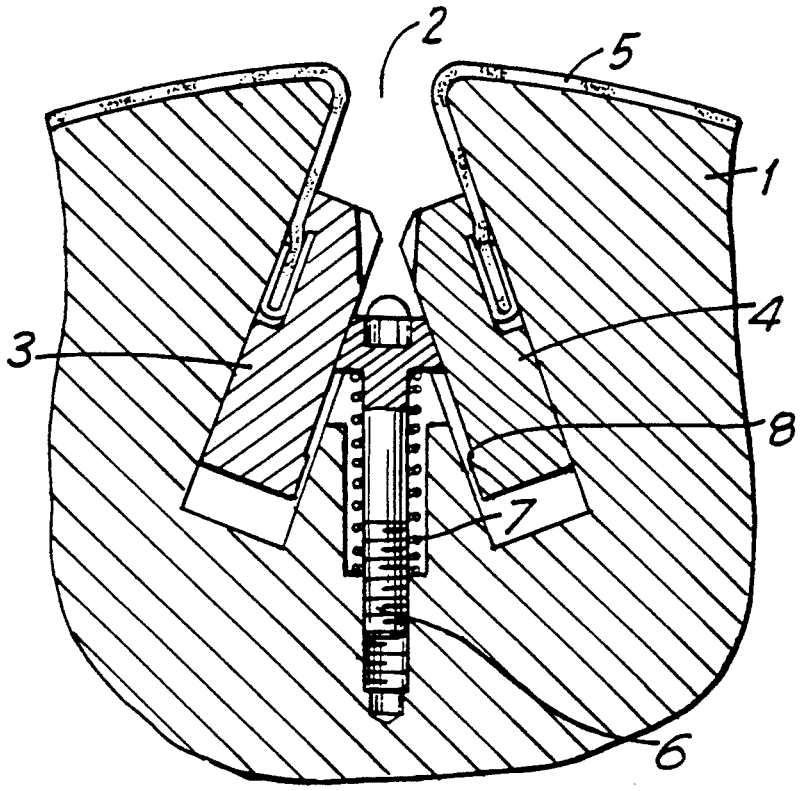
FIG. 1 is a partial sectional view of a blanket clamping device according to the present invention with two clamping rails in the clamping duct.

As illustrated in FIG. 1, a transfer cylinder 1 of an offset rotary printing machine has a clamping duct 2 in which are arranged two clamping rails 3, 4. The ends of a rubber blanket 5 are in engagement with the clamping rails 3, 4. The clamping rails 3, 4 are tightened against the bottom of the clamping duct by means of a plurality of tightening screws which are distributed over the length of the clamping duct.

Several tightening screws 6 with a truncated cone-shaped head are arranged in the center of the gap between the clamping rails, 3, 4 and distributed over the length of the clamping duct. The head of each tightening screw has a hexagonal recess and the tightening screws can be screwed out of the body of the cylinder by means of an appropriate wrench into the conical gap defined between the clamping rails 3, 4. As a result, a clamping action is obtained between the tightening screws and the clamping rails and between the clamping rails and the walls of the clamping duct.

A compression spring 7 on the shaft of the screw 6 rests against the body of the cylinder and against the head of the screw and, consequently, prevents unintended downward movement of the screw 6. When the clamping action of the clamping rails 3, 4 is absent or insufficient and the clamping rails 3, 4 are loosened, they can only travel in the direction out of the clamping duct until the step 8 rests against the head of the screw 6. As a result, the clamping rails 3, 4 cannot project beyond the periphery of the cylinder.

Figure 2:
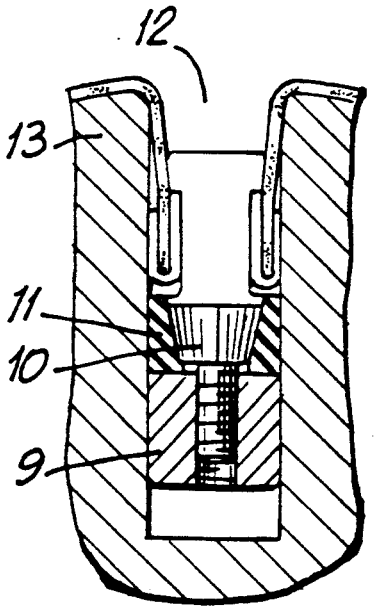
FIG. 2 is a partial sectional view of a blanket clamping device according to the present invention with one clamping rail in the clamping duct.
Figure 3:
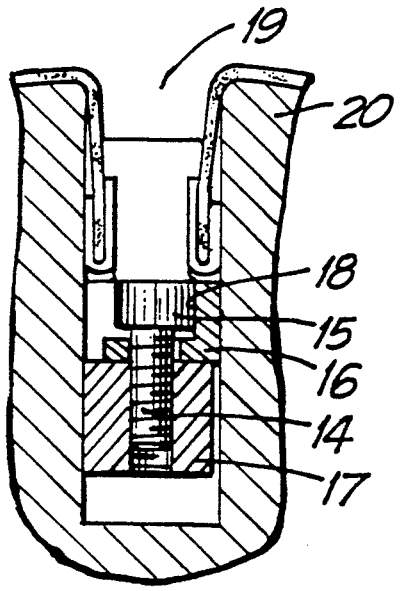
FIG. 3 is a partial sectional view of another embodiment of a blanket clamping device with one clamping rail in the clamping duct.

FIGS. 2 and 3 of the drawings show blanket clamping devices with only one clamping rail 9 in the clamping duct 12. The clamping rail 9 has on both sides grooves for receiving the ends of the blanket. Also, the clamping rails shown in FIGS. 2 and 3 of the drawing have several slots distributed over the length thereof for receiving securing elements for preventing loosening of the clamping rails.

In FIG. 2, a securing screw 10 is screwed into the clamping rail 9 and a sleeve 11 of an elastic material, for example, Desmopan, is placed on the securing screw 10. After the clamping rail 9 has been clamped in a manner which is not illustrated, the securing screw 10 is screwed in by means of a wrench engaged in a hexagonal recess of the head of the screw and the sleeve 11 is expanded when the truncated cone-shaped head of the screw enters the sleeve 11. As a result, the sleeve 11 rests against the walls of the clamping duct 12 of the transfer cylinder 13 and tightly clamps the clamping rail 9. This embodiment can be modified by providing the securing screw with a normally shaped head and a sleeve under the head which is squeezed when the securing screw is screwed in.

In the embodiment of FIG. 3, a securing screw 14 is used which has an eccentric head 15. The securing screw 14 is screwed into the clamping rail 17 with a sliding block 16 being arranged between the securing screw 14 and the clamping rail 17. The clamping rail 17 is secured by turning the eccentric head 15 against the edge 18 of the sliding block 16 by means of a wrench inserted into a hexagonal recess of the head 15. This provides a self-locking action between the securing screw 14 and the sliding block 16 and between the clamping rail 17 and the wall of the clamping duct 19 of the transfer cylinder 20.

It should be understood that the preferred embodiments and examples described are for illustrative purposes only and are not to be construed as limiting the scope of the present invention which is properly delineated only in the appended claims.

We claim:

1. A blanket clamping device for clamping a blanket mounted on a transfer cylinder of an offset rotary printing machine, the transfer cylinder having a periphery and an axis and a clamping duct extending in axial direction of the transfer cylinder, the clamping duct having a bottom with a bore therein and being open at the periphery of the transfer cylinder, the blanket having ends, the blanket clamping device comprising two clamping rails mounted in the clamping duct, each of the clamping rails being connected to one of the ends of the blanket, the clamping rails extending at an angle relative to each other and having surfaces defining a gap therebetween, the gap having a center, at least one screw mounted in the center of the gap and screwed into the bore in the bottom of the clamping duct, the screw having a truncated cone-shaped head, the clamping rails each having a surface facing the truncated cone-shaped head of the at least one screw, each of the surfaces of the clamping rails defining a step, such that the truncated cone-shaped head prevents movement of the clamping rails past the periphery of the transfer cylinder by engaging the steps.

2. The blanket clamping device according to claim 1, wherein the at least one screw has a shaft, further comprising a compression spring mounted on the shaft and contacting the truncated cone-shaped head and the bottom of the clamping duct.

* * * * *